US011642719B1

(12) United States Patent
Marcin et al.

(10) Patent No.: US 11,642,719 B1
(45) Date of Patent: May 9, 2023

(54) HYBRID CASTING PROCESS FOR STRUCTURAL CASTINGS

(71) Applicant: Hamilton Sundstrand Corporation, Charlotte, NC (US)

(72) Inventors: John Joseph Marcin, Marlborough, CT (US); Darrell J. Holding, Seward, AK (US); Christopher Heinze, Blaine, MN (US); Ryan Tonk, South Bend, IN (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 17/644,911

(22) Filed: Dec. 17, 2021

(51) Int. Cl.

| | |
|---|---|
| ***B22D 27/04*** | (2006.01) |
| ***B22D 29/00*** | (2006.01) |
| ***B22D 31/00*** | (2006.01) |
| ***B22C 9/06*** | (2006.01) |
| ***B22C 9/10*** | (2006.01) |

(52) U.S. Cl.
CPC ..... *B22C 9/065* (2013.01); *B22C 9/10* (2013.01); *B22D 29/005* (2013.01)

(58) Field of Classification Search
CPC .. B22C 9/06; B22C 9/064; B22C 9/10; B22C 9/108; B22D 27/04; B22D 29/00; B22D 31/00
USPC ..... 164/69.1, 122, 125, 131, 137, 339, 340, 164/342, 369, 397
See application file for complete search history.

(56) References Cited

U.S. PATENT DOCUMENTS

| | | | | |
|---|---|---|---|---|
| 9,737,929 | B2 | 8/2017 | Morais et al. | |
| 2007/0289715 | A1* | 12/2007 | Crafton et al. | B22D 29/003 164/338.1 |
| 2019/0329318 | A1 | 10/2019 | Koduri et al. | |

FOREIGN PATENT DOCUMENTS

| | | | |
|---|---|---|---|
| IT | MO20110159 | A1 | 12/2012 |

OTHER PUBLICATIONS

Extended European Search Report for EP Application No. 22211469.6, dated Mar. 15, 2023, p. 10.

* cited by examiner

*Primary Examiner* — Kevin P Kerns
(74) *Attorney, Agent, or Firm* — Kinney & Lange, P. A.

(57) ABSTRACT

A hybrid casting process for structural components uses a re-usable metallic mold rather than a sand mold to produce more consistent cast components. The hybrid casting process uses a metallic mold coupled to a core mold to produce the near net shape of the cast component. Machining operations are performed on the near net shape cast component to produce a final component that meets tolerances and other specifications of the structural component.

15 Claims, 4 Drawing Sheets

HYBRID CASTING PROCESS FOR STRUCTURAL CASTINGS

BACKGROUND

The present invention relates to casting metallic components and, more particularly, to a hybrid casting process for structural castings that uses a reusable metallic mold to produce the structural castings.

Many metallic components are produced using casting processes, a common casting process used is sand casting. Sand casting is a metal casting process characterized by using sand as the mold material. Sand casting uses mold boxes, known as flasks, filled with compacted sand to produce the mold cavities and gate system that is filled with molten metal to create the cast component. Sand casting is a relatively cheap method of casting components, but it also can result in lower quality and less predictable results of the final cast component. Components that require high accuracy, tight tolerances, and internal passages can be difficult to produce using sand casting processes. Other casting processes, such as investment casting, give a higher degree of precision for highly complex parts but are usually applied to smaller components than sand casting processes. Further, permanent mold and die casting processes are used for high-volume industries but typically make less complex parts than sand or investment casting processes. As such, there is a need for a casting process with less variation, better quality, and more predictable results for the final cast component.

SUMMARY

According to one aspect of the disclosure, a method for producing structural components is disclosed. The method includes aligning a core within a metallic mold by coupling the core to metallic locators attached to the metallic mold; filling the metallic mold with a molten metallic material; solidifying the metallic material within the metallic mold to produce a cast component; removing the cast component from the metallic mold; identifying a datum location, wherein the datum location is a central axis of an aperture extending through the cast component to the core; and removing material from one or more of an internal surface and external surface of the cast component based off the datum location.

According to another aspect of the disclosure, a casting assembly for producing a structural component is disclosed. The casting assembly includes a metallic mold and a core. The metallic mold includes walls, a heating device, and a cooling device. The walls define surfaces of the structural component. The heating device is coupled to the metallic mold and the heating device is configured to increase the temperature of surfaces of the metallic mold. The cooling device is coupled to the metallic mold and the cooling device is configured to decrease the temperature of surfaces of the metallic mold. The core is positioned within the walls of the metallic mold.

DETAILED DESCRIPTION

This disclosure presents a hybrid casting process which uses the advantages of several casting processes to optimize the final cast component. The hybrid casting process uses conventionally manufactured or additively manufactured internal cores to produce complex internal passages as used in the sand-casting process. The hybrid casting process enables complex internal and external geometries as achieved in investment casting. Further, the hybrid casting process utilizes actively heated and/or cooled permanent molds, as used in die casting, to provide thermal control for optimum solidification of specific areas of the casting without relying on excessive gating systems/channels to feed metal into the part. The permanent molds can be filled with loose or chemically set sand to create a mold around the additive cores or a fluid ceramic media can be introduced to create a mold as in solid mold or investment casting. As such, the hybrid casting process results in less variation, better quality, and more predictable results for the final cast component.

Figure 1:
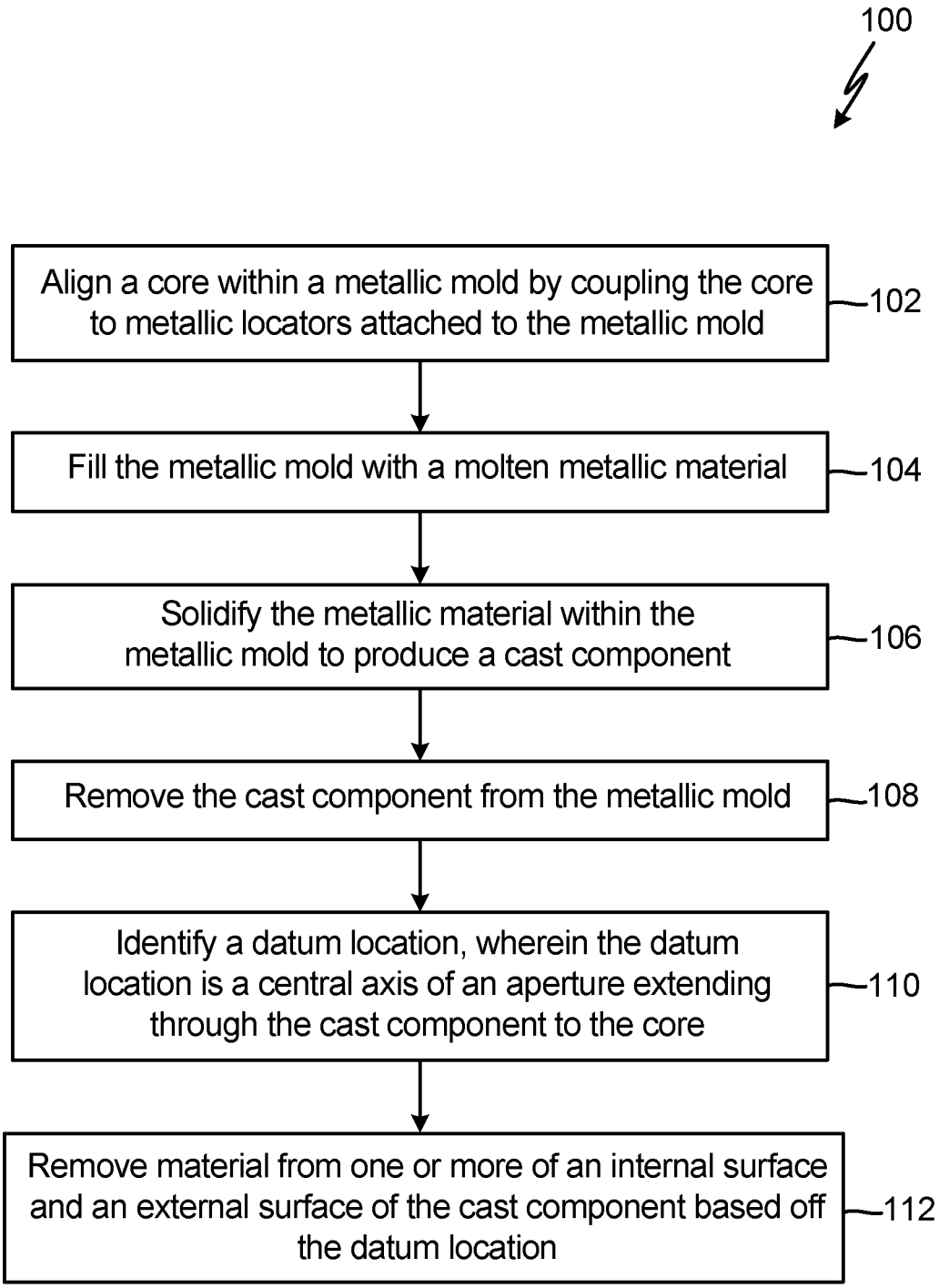
FIG. 1 is a flow chart illustrating steps of a method for producing structural components using a hybrid casting process.
Figure 2A:
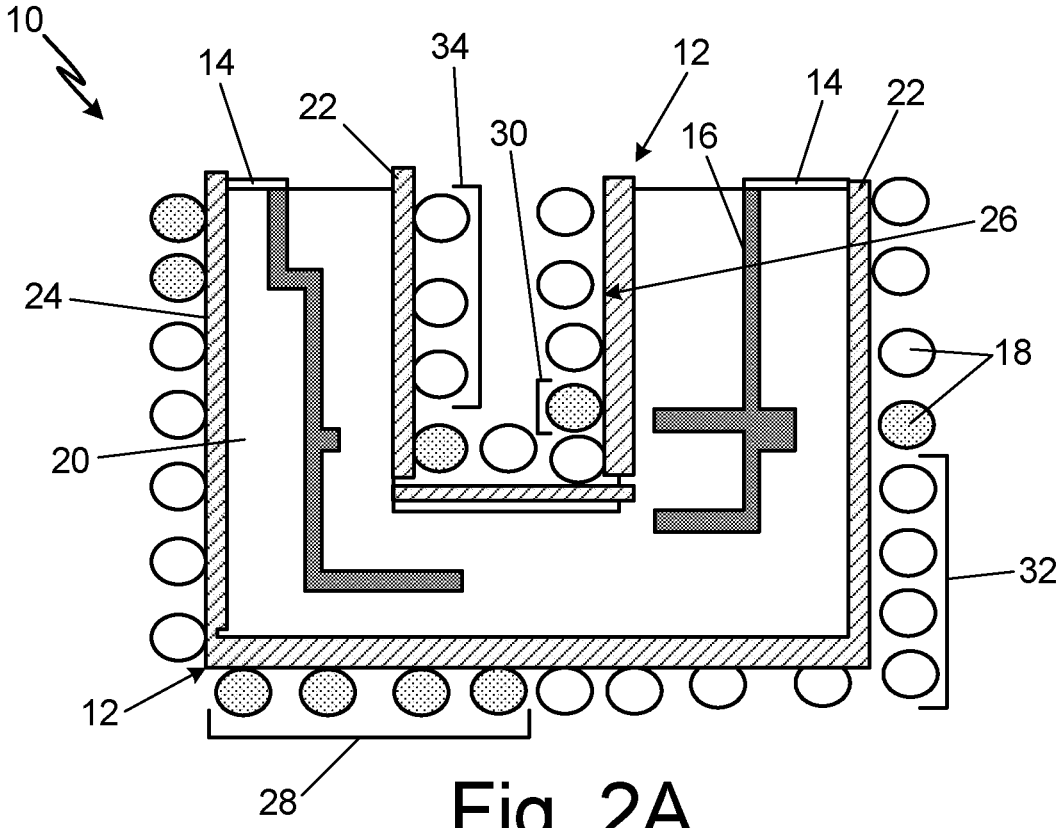
FIG. 2A is a schematic cross-sectional diagram illustrating a first step of the hybrid casting process.
Figure 2B:
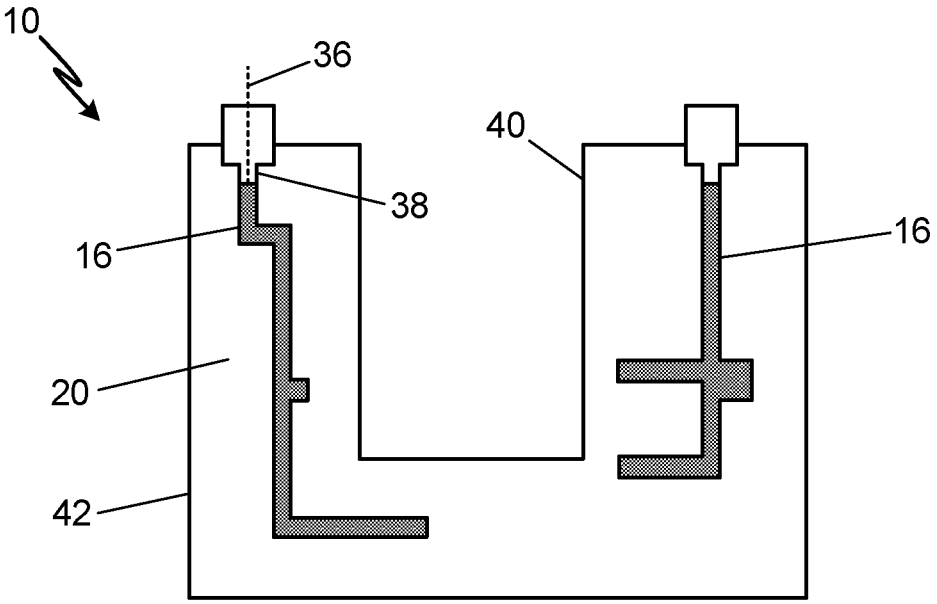
FIG. 2B is a schematic cross-sectional diagram illustrating a second step of the hybrid casting process.
Figure 2C:
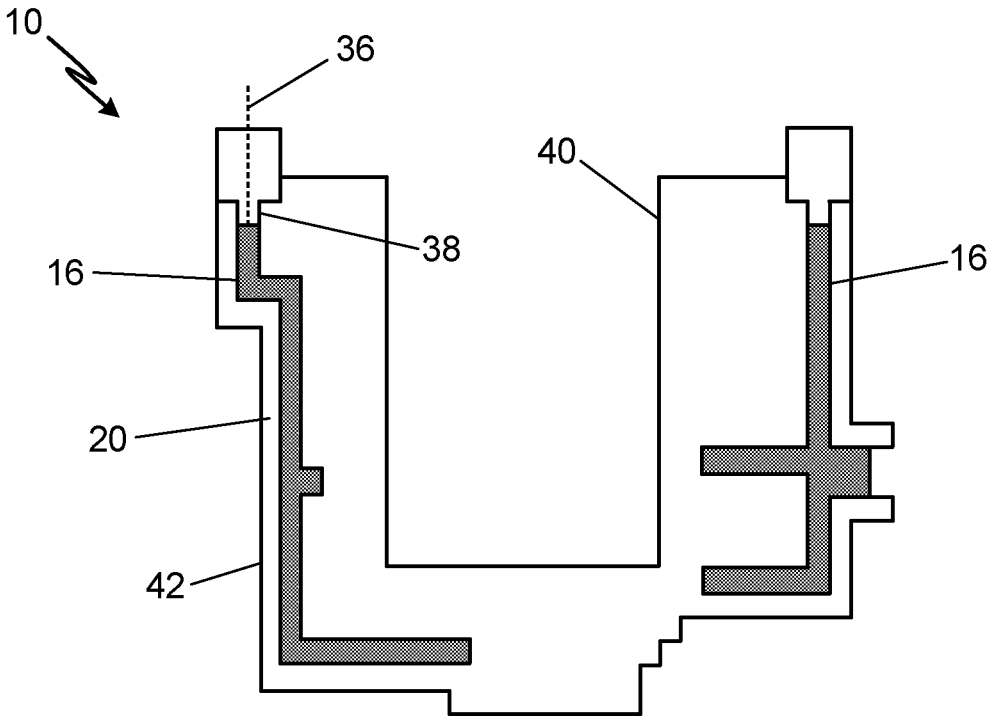
FIG. 2C is a schematic cross-sectional diagram illustrating a third step of the hybrid casting process.
Figure 2D:
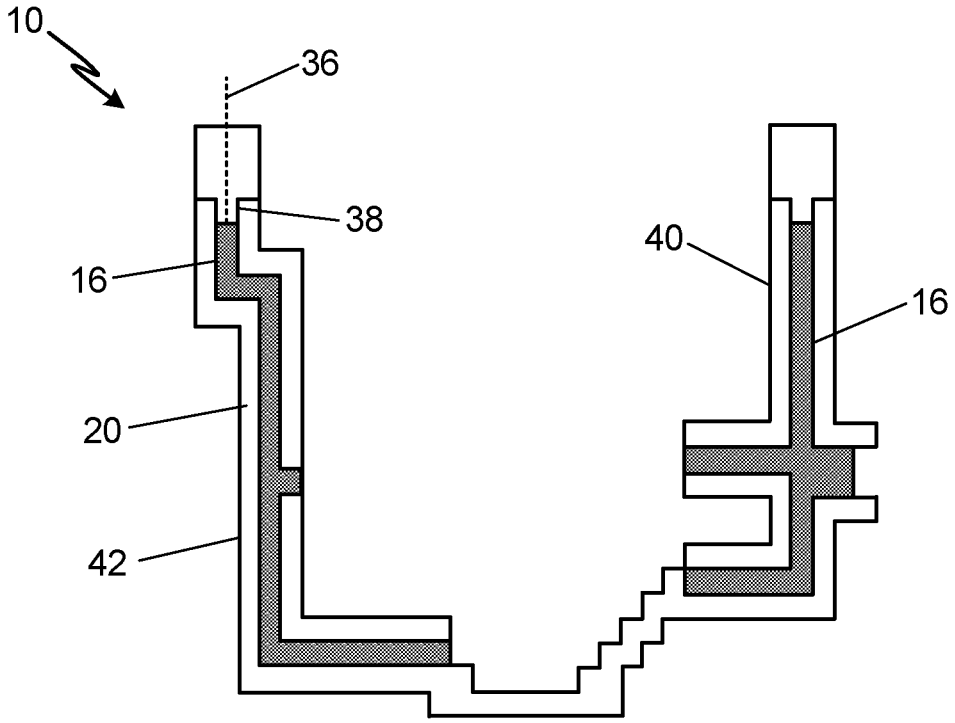
FIG. 2D is a schematic cross-sectional diagram illustrating a fourth step of the hybrid casting process.
Figure 2E:
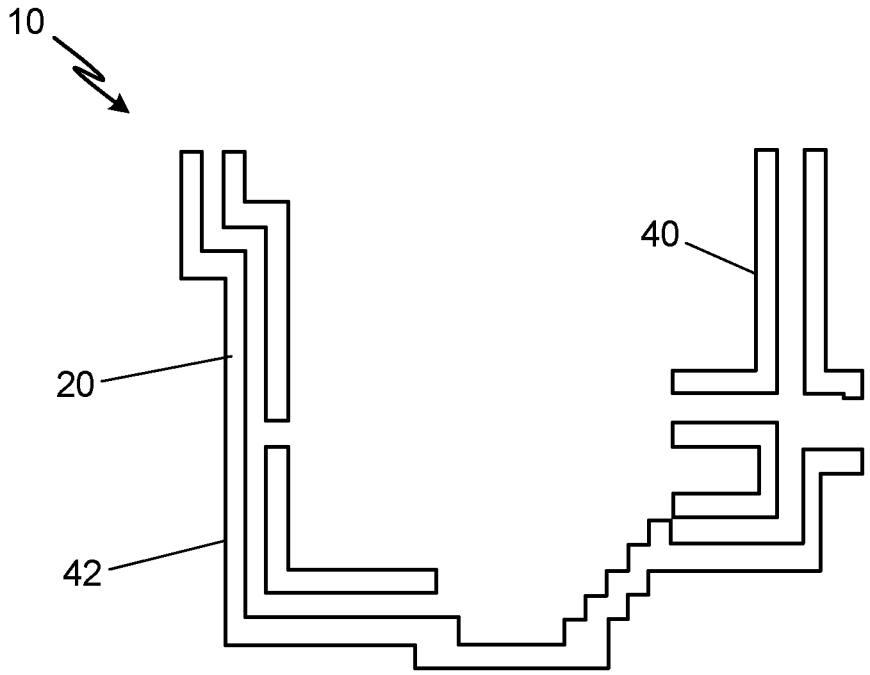
FIG. 2E is a schematic cross-sectional diagram illustrating a structural component produced using the hybrid casting process.

FIG. 1 is a flow chart illustrating steps of method 100 for producing structural components using a hybrid casting process. FIG. 2A is a schematic diagram showing a first step of method 100. FIG. 2B is a schematic diagram showing a second step of method 100. FIG. 2C is a schematic diagram showing a third step of method 100. FIG. 2D is a schematic diagram showing a fourth step of method 100. FIG. 2E is a schematic cross-sectional diagram illustrating a structural component produced using the hybrid casting process. FIGS. 1-2E will be discussed together.

Method 100 includes steps 102, 104, 106, 108, 110, and 112. As shown best in FIG. 2A, step 102 includes aligning core 16 within metallic mold 12 by coupling core 16 to metallic locators 14 attached to metallic mold 12. Step 104 includes filling metallic mold 12 with a molten metallic material. Step 106 includes solidifying the metallic material within metallic mold 12 to produce cast component 20. As shown best in FIG. 2B, step 108 includes removing cast component 20 from metallic mold 12. Step 110 includes identifying datum location 36, wherein datum location 36 is a central axis of aperture 38 extending through cast component 20 to core 16. As shown best in FIGS. 2C-2D, step 112 includes removing material from one or more of internal surface 40 and external surface 42 of cast component 20 based off datum location 36. Each of steps 102-112 will be discussed in further detail below.

Referring again to FIG. 2A, casting assembly 10 for producing structural components is shown. Casting assembly 10 includes metallic mold 12, metallic locators 14, core 16, and fluid channels 18. Metallic mold 12 is a hollow container used to give shape to a molten or hot liquid material when it cools and hardens. Metallic mold 12 includes walls 22 defining surfaces of the to be cast component 20. More specifically, walls 22 of metallic mold 12 are used to produce external and/or internal surfaces of cast component 20. Each individual wall 22 of metallic mold 12 can be coupled together to form the overall shape of metallic mold 12 and the to be cast component 20. In some examples, walls 22 of metallic mold 12 can be coupled together using fasteners that can be removed to separate and decouple walls 22 of metallic mold 12. In other examples, walls 22 of metallic mold 12 can be coupled together through welds and/or formed from a single piece of material through machining operations. Metallic mold 12 is constructed from a metallic material, and in some examples, metallic mold 12 can be constructed from one or more of a cast iron, alloy steel, nickel alloy, copper alloy, and tungsten alloy. Further, metallic mold 12 is constructed from a material that has a higher temperature melting point than the metallic material poured into metallic mold 12.

In the example shown, metallic mold 12 is a generally cube or box shaped mold, such that the resulting cast component 20 has a generally cube or box shaped external shape. In this example, the generally cube or box shaped cast component 20 has greater external tolerancing and flexibility but requires more machining operations to achieve the desired final external shape of the cast structural component. In another example, metallic mold 12 can be shaped to generally conform to the desired final external geometry of the cast structural component. In such an example, walls 22 of metallic mold 12 can have a complex shape that generally outlines the external geometry of the desired cast structural component. In this example, cast component 20 with a near net external geometry requires less machining operations to achieve the desired final external shape but also has less flexibility, as compared to a generally cube or box shaped mold, discussed further below.

Metallic locators 14 are positioned adjacent a top of metallic mold 12 and locators 14 extend inward toward a center of metallic mold 12. Locators 14 are removably coupled to metallic mold 12 such that locators 14 can be coupled and decoupled from metallic mold 12 as required during the casting process. Locators 14 are configured to aid in properly positioning and aligning core 16 within metallic mold 12, discussed further below. In some examples, locators 14 can be one or more of a pin, an aperture, a hook, an indent, a clevis, or a surface, among other options. In the example shown there are two locators 14, each positioned on opposite sides of metallic mold 12 and extending inward toward a center of metallic mold 12. In another embodiment, there can be more or less than two locators 14 coupled to metallic mold 12 and locators 14 can be positioned at any desired location on metallic mold 12. In any embodiment, locators 14 are configured to accurately position core 16 within metallic mold 12 to meet internal and external tolerancing and other requirements for internal features of the final cast structural component.

Core 16 is a component of casting assembly 10 that is utilized to produce one or more internal passages and internal features within cast component 20, producing internal features of the cast structural component. In some examples, core 16 can be utilized to produce fluid flow channels within a structural component that cannot be produced using traditional drilling, milling, or turning operations. Core 16 can be a ceramic core that is constructed from a ceramic material. Core 16 can be produced using a casting process or through an additive manufacturing process. As previously introduced, step 102 of method 100 includes aligning core 16 within metallic mold 12 by coupling core 16 to metallic locators 14 attached to metallic mold 12. More specifically, a machine tool (not shown) is utilized to lower core 16 within walls 22 of metallic mold 12. Core 16 is lowered into metallic mold 12 until core 16 interfaces with locators 14 coupled to metallic mold 12. Core 16 is then coupled to locators 14, securing core 16 to locators 14 and metallic mold 12. Core 16 is now precisely positioned within metallic mold 12 to produce internal passages and internal features within cast component 20 and the final cast structural component.

Step 104 includes filling metallic mold 12 with a molten metallic material. More specifically, a metallic material is heated to a temperature above the metallic materials melting point to produce liquefied metal. The molten metallic material is poured into metallic mold 12 with the coupled core 16, such that the molten metallic material fills metallic mold 12 and surrounds core 16 positioned within metallic mold 12. In some examples, the molten metallic material can be one or more of an aluminum alloy and a magnesium alloy, among other options. Step 106 includes solidifying the metallic material within metallic mold 12 to produce cast component 20. Solidifying the metallic material includes strategically allowing the metallic material to cool in temperature to solidify into a solid metallic cast component 20 with specific material properties. The specific material properties for cast component 20 will vary depending on the structural component being produced and the requirements for the mechanical and thermal properties of the structural component. The material properties of cast component 20 can be controlled through thermal management techniques that alter the solidification dynamics of cast component 20.

As shown in FIG. 2A, casting assembly 10 can include fluid channels 18 that are utilized to control the solidification dynamics of cast component 20. Fluid channels 18 can be positioned adjacent walls 22 of metallic mold 12 and fluid channels 18 are configured to provide a flow path for heating or cooling fluid to flow through. Fluid channels 18 can be one or more of a tube, hose, channel, conduit, or the like that includes a hollow central portion in which heating or cooling fluid can flow through. In some examples, fluid channels are positioned within walls 22 of metallic mold 12 such that fluid channels 18 are integral with walls 22 of metallic mold 12. In other examples, fluid channels 18 can be affixed to exterior surfaces 24 and interior surfaces 26 of walls 22 of metallic mold 12. Fluid channels 18 are fluidly coupled to a fluid source (not shown) positioned remote from casting assembly 10 and fluid channels 18 are configured to receive fluid from the fluid source. Fluid channels 18 can be separated into groups of channels such that some fluid channels 18 have a hot fluid flowing through them and other fluid channels 18 have a cold fluid flowing through them. Fluid channels 18 with hot fluid flowing through the fluid channels are configured to heat metallic mold 12. Fluid channels 18 with cold fluid flowing through the fluid channels are configured to cool metallic mold 12. In some examples, thinner portions of metallic mold 12 may require heating and thicker portions of metallic mold 12 may require cooling to achieve the desired solidification dynamics of cast component 20. In other examples, heating or cooling specific sections of the mold may also be accomplished by use of electric resistance heaters, inductions coils, or the use of a variety of conductive metals or ceramic media with heat transfer attributes.

In the example shown in FIG. 2A, casting assembly 10 includes a plurality of sections/portions that have either heating or cooling fluid channels 18 positioned adjacent walls 22 of metallic mold 12. More specifically, metallic mold 12 can include at least a first portion 28, a second portion 30, a third portion 32, and a fourth portion 34. In some examples, first portion 28 of metallic mold 12 can be positioned adjacent exterior surface 24 of metallic mold 12;

second portion 30 of metallic mold 12 can be positioned adjacent interior surface 26 of metallic mold 12; third portion 32 of metallic mold 12 can be positioned adjacent exterior surface 24 of metallic mold 12; and fourth portion 34 of metallic mold 12 can be positioned adjacent interior surface 26 of metallic mold 12. Further, in some examples, first portion 28 and second portion 30 of metallic mold 12 include hot fluid channels 18 and the hot fluid flowing through fluid channels 18 heats first portion 28 and second portion 30 of metallic mold 12. In addition, in some examples, third portion 32 and fourth portion 34 of metallic mold 12 include cold fluid channels 18 and the cold fluid flowing through fluid channels 18 cools third portion 32 and fourth portion 34 of metallic mold 12. In other examples, metallic mold 12 can include at least one heating device and at least one cooling device that are coupled to metallic mold 12 and configured to increase and decrease the temperature of surfaces of metallic mold 12, respectively. In one example, the heating device can be a resistance heating element configured to increase in temperature when an electric current is supplied to the resistance heating element.

As such, metallic mold 12 can include hot/cold fluid channels 18 and/or heating/cooling devices that are configured to heat and cool different portions of metallic mold 12 to achieve the desired solidification dynamics of cast component 20. In some examples, thinner portions of cast component 20 may require heating and thicker portions of cast component 20 may require cooling during the solidification process to achieve the desired cooling characteristics and mechanical and thermal properties for cast component 20. Further, metallic mold 12 being constructed from a metallic material aids in the solidification process because metal is conductive and more effective at heating and cooling, as compared to traditional sand molds which are insulators. In addition, metallic mold 12 including heating and cooling devices is advantageous over traditional sand molding because it eliminates the need for at least some venting, gating, and waste flow channels that were previously required to achieve proper cooling characteristics for large structural cast components.

More specifically, metallic mold 12 including heating and cooling devices is advantageous over traditional sand molding because the casting process requires less metal to cast the part due to relying on active heating and cooling rather than gating systems to achieve a sound casting with desirable material properties. Removing the traditional gating systems results in less overall metallic material used during the casting process, less waste, and in turn lower costs for producing the structural component. In turn, this compensates for a larger external envelope for the part that will require machining to final dimensions. As such, controlling the solidification process of cast component 20 is key to achieving a final structural component with the desired mechanical and thermal properties, while also reducing waste and increasing profits.

As shown in FIG. 2B, step 108 includes removing cast component 20 from metallic mold 12. After cast component 20 has completed the solidification process, cast component 20 is removed from metallic mold 12. Cast component 20 can be removed from metallic mold 12 using various techniques. In one example, the fasteners coupling walls 22 of metallic mold 12 are removed and walls 22 are separated from cast component 20. In another example, an aperture within metallic mold 12 allows access to a bottom side of cast component 20 and cast component 20 can be pushed from a bottom surface upward to separate cast component 20 from metallic mold 12. Then a crane, hoist, or other similar device can be used to raise cast component 20 from metallic mold 12. Once cast component 20 is removed from metallic mold 12, core 16 is removed from cast component 20 and the hollow channels and/or features remain within the interior of cast component 20. In one example, core 16 can be removed from cast component 20 by breaking core 16 into small pieces and then the small pieces are shaken out from the interior of cast component 20. In another example, a release agent/liquid can be applied to core 16 and a heating process can be used to melt/dissolve core 16 into smaller particles that can then be poured or shaken out from the interior of cast component 20.

Step 110 includes identifying datum location 36, wherein datum location 36 can be a central axis of aperture 38 extending through cast component 20 to core 16. Datum location 36 is a reference point on or within cast component 20 in which all final edges and surfaces of the structural component are measured from. More specifically, datum location 36 is a fixed starting point in which all machining operations are measured from to produce the final external dimensions and geometry of the structural component. In one examples, datum location 36 can be a central axis of aperture 38 extending through cast component 20. In other examples, datum location can be a surface, edge, or other feature of cast component 20 in which all final edges and surfaces of the structural component are measured from.

As shown best in FIGS. 2C-2D, step 112 includes removing material from one or more of internal surface 40 and external surface 42 of cast component 20 based off datum location 36. More specifically, a CNC machine is used to machine and remove material from internal surfaces 40 and external surfaces 42 of cast component 20 to produce the final dimensions and geometry of the structural component. Removing material from internal surfaces 40 and external surfaces 42 of cast component 20 can be one or more of a turning operation, drilling operation, and milling operation, among other options. The CNC machine uses datum location 36 as the origin (0,0 location) in which all geometric dimensions and tolerances are measured from to ensure the final machined cast component 20 meets the dimensional requirements for the desired structural component. FIG. 2E is a schematic cross-sectional diagram illustrating an example structural component produced using the hybrid casting process.

The hybrid casting process described in method 100 produces cast components that have less variation, better quality, and more predictable results, resulting in high customer satisfaction and lower overall costs. The hybrid casting process provides a method to control internal and external casting mold movement to produce a higher percentage of conforming structural components. The hybrid casting process provides a method to consistently align core 16 within metallic mold 12, reducing variation from part to part. Further, providing metallic mold 12 with excess material on external surfaces 42 of cast component 20 allows for a simpler external envelope which can be more readily cast and machined to final desired dimensions during the final machining processes to achieve the desired dimensions and tolerances for all internal and external features of the cast structural component. Metallic mold 12 is a reusable mold that can be used to produce many structural components with the same mold, thus metallic mold 12 reduces variation from part to part as compared to traditional sand molds. Method 100 and the hybrid casting process produce internal features with less variation by allowing more internal tolerance which is balanced by external machining to achieve to final external geometry. Further, method 100 and casting assembly 10 allow for more effective thermal management during the cooling of cast component 20 which produces better castings, as compared to traditional sand castings. The reusable metallic mold 12 gives a more consistent product than expendable sand molds with less process variation, leading to better quality, less material waste, lower cost, more predictable results, and high customer satisfaction.

Discussion of Possible Embodiments

The following are non-exclusive descriptions of possible embodiments of the present invention.

A method for producing structural components, the method comprising: aligning a core within a metallic mold by coupling the core to metallic locators attached to the metallic mold; filling the metallic mold with a molten metallic material; solidifying the metallic material within the metallic mold to produce a cast component; removing the cast component from the metallic mold; identifying a datum location, wherein the datum location is a central axis of an aperture extending through the cast component to the core; and removing material from one or more of an internal surface and external surface of the cast component based off the datum location.

The method of the preceding paragraph can optionally include, additionally and/or alternatively, any one or more of the following features, configurations and/or additional components:

Heating a first portion of the metallic mold during the solidifying of the metallic material within the metallic mold; heating a second portion of the metallic mold during the solidifying of the metallic material within the metallic mold; cooling a third portion of the metallic mold during the solidifying of the metallic material within the metallic mold; and cooling a fourth portion of the metallic mold during the solidifying of the metallic material within the metallic mold.

The first portion of the metallic mold is on an exterior surface of the metallic mold; the second portion of the metallic mold is on an interior surface of the metallic mold; the third portion of the metallic mold is on an exterior surface of the metallic mold; and the fourth portion of the metallic mold is on an interior surface of the metallic mold.

The metallic mold comprises fluid channels positioned within walls of the metallic mold; hot fluid flows through the fluid channels to heat the metallic mold; and cold fluid flows through the fluid channels to cool the metallic mold.

Fluid channels are affixed to walls of the metallic mold; hot fluid flows through the fluid channels to heat the metallic mold; and cold fluid flows through the fluid channels to cool the metallic mold.

A resistance heating element is coupled to walls of the metallic mold, and wherein an electric current is supplied to the resistance heating element to heat the metallic mold.

The metallic mold is shaped to conform to external surfaces of the structural component.

The metallic mold is a generally cube or box shaped mold.

The core is a ceramic core constructed from a ceramic material.

The metallic mold is constructed from one or more of a cast iron, alloy steel, nickel alloy, copper alloy, and tungsten alloy.

The metallic material is one or more of an aluminum alloy and a magnesium alloy.

The metallic mold has a higher temperature melting point than the metallic material poured into the metallic mold.

The core is utilized to produce one or more of internal passages and internal features within the cast component.

The core is removed from the cast component by breaking the core into pieces and shaking the core from an interior of the cast component.

The datum location is a reference point in which all edges and surfaces of the structural component are measured from.

Removing material from the internal and external surfaces of the cast component can be one or more of a turning operation, drilling operation, and milling operation.

The following are further non-exclusive descriptions of possible embodiments of the present invention.

A casting assembly for producing a structural component, the casting assembly comprising: a metallic mold comprising: walls defining surfaces of the structural component; a heating device coupled to the metallic mold, wherein the heating device is configured to increase the temperature of surfaces of the metallic mold; and a cooling device coupled to the metallic mold, wherein the cooling device is configured to decrease the temperature of surfaces of the metallic mold; and a core positioned within the walls of the metallic mold.

The casting assembly of the preceding paragraph can optionally include, additionally and/or alternatively, any one or more of the following features, configurations and/or additional components:

The heating device and cooling device are fluid channels positioned within the walls the metallic mold, and wherein hot fluid flows through the fluid channels to heat the metallic mold and cold fluid flows through the fluid channels to cool the metallic mold.

The metallic mold is constructed from one or more of a steel, titanium, copper, and tungsten.

The core is a ceramic core constructed from a ceramic material; the core is utilized to produce one or more internal passages and internal features within the structural component; and the core is removed from the structural component by breaking the core into pieces and shaking the core from an interior of the structural component.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method for producing a structural component, the method comprising:

aligning a core within a metallic mold by coupling the core to metallic locators attached to the metallic mold;

filling the metallic mold with a molten metallic material;

solidifying the metallic material within the metallic mold to produce a cast component;

removing the cast component from the metallic mold;

identifying a datum location, wherein the datum location is a central axis of an aperture extending through the cast component to the core;

removing material from one or more of an internal surface and external surface of the cast component based off the datum location;

heating a first portion of the metallic mold during the solidifying of the metallic material within the metallic mold;

heating a second portion of the metallic mold during the solidifying of the metallic material within the metallic mold;

cooling a third portion of the metallic mold during the solidifying of the metallic material within the metallic mold; and cooling a fourth portion of the metallic mold during the solidifying of the metallic material within the metallic mold.

2. The method of claim 1, wherein:

the first portion of the metallic mold is on an exterior surface of the metallic mold;

the second portion of the metallic mold is on an interior surface of the metallic mold;

the third portion of the metallic mold is on an exterior surface of the metallic mold; and the fourth portion of the metallic mold is on an interior surface of the metallic mold.

3. The method of claim 1, wherein:

the metallic mold comprises fluid channels positioned within walls of the metallic mold;

hot fluid flows through the fluid channels to heat the metallic mold; and cold fluid flows through the fluid channels to cool the metallic mold.

4. The method of claim 1, wherein:

fluid channels are affixed to walls of the metallic mold;

hot fluid flows through the fluid channels to heat the metallic mold; and cold fluid flows through the fluid channels to cool the metallic mold.

5. The method of claim 1, wherein a resistance heating element is coupled to walls of the metallic mold, and wherein an electric current is supplied to the resistance heating element to heat the metallic mold.

6. The method of claim 1, wherein the metallic mold is shaped to conform to external surfaces of the structural component.

7. The method of claim 1, wherein the metallic mold is a cube or box shaped mold.

8. The method of claim 1, wherein the core is a ceramic core constructed from a ceramic material.

9. The method of claim 1, wherein the metallic mold is constructed from one or more of a cast iron, alloy steel, nickel alloy, copper alloy, and tungsten alloy.

10. The method of claim 1, wherein the metallic material is one or more of an aluminum alloy and a magnesium alloy.

11. The method of claim 1, wherein the metallic mold has a higher temperature melting point than the metallic material poured into the metallic mold.

12. The method of claim 1, wherein the core is utilized to produce one or more of internal passages and internal features within the cast component.

13. The method of claim 12, wherein the core is removed from the cast component by breaking the core into pieces and shaking the core from an interior of the cast component.

14. The method of claim 1, wherein the datum location is a reference point in which all edges and surfaces of the structural component are measured from.

15. The method of claim 1, wherein removing material from the internal and external surfaces of the cast component is one or more of a turning operation, drilling operation, and milling operation.

* * * * *